US006659884B2

(12) United States Patent
Knuth

(10) Patent No.: US 6,659,884 B2
(45) **Date of Patent: *Dec. 9, 2003**

(54) GOLF CLUB HEAD

(75) Inventor: Dean Leslie Knuth, Bonita, CA (US)

(73) Assignee: Panda Golf, Inc., Bonita, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/062,234

(22) Filed: Feb. 1, 2002

(65) Prior Publication Data

US 2003/0148822 A1 Aug. 7, 2003

(51) Int. Cl.[7] ..... A63B 53/04

(52) U.S. Cl. ..... 473/329; 473/342; 473/345; 473/349; 473/350

(58) Field of Search ..... 473/327, 329, 473/344, 345, 349, 324, 291, 342, 346, 350; D21/733

(56) References Cited

U.S. PATENT DOCUMENTS

| | | | | | |
|---|---|---|---|---|---|
| D93,862 | S | * | 11/1934 | Barnhart | D21/733 |
| 4,432,549 | A | | 2/1984 | Zebelean | |
| 5,028,049 | A | | 7/1991 | McKeighen | |
| 5,318,300 | A | | 6/1994 | Schmidt et al. | |
| 5,362,047 | A | | 11/1994 | Shaw et al. | |
| 5,366,223 | A | | 11/1994 | Werner et al. | |
| 5,547,188 | A | | 8/1996 | Dumontier et al. | |
| 5,611,741 | A | | 3/1997 | Schmidt et al. | |
| 5,624,331 | A | * | 4/1997 | Lo et al. | 473/345 |
| 5,830,084 | A | | 11/1998 | Kosmatka | |
| 5,954,596 | A | | 9/1999 | Noble et al. | |
| 5,971,868 | A | | 10/1999 | Kosmatka | |
| 5,989,134 | A | * | 11/1999 | Antonious | 473/327 |
| 6,027,416 | A | | 2/2000 | Schmidt et al. | |
| 6,074,308 | A | * | 6/2000 | Domas | 473/327 |
| 6,277,033 | B1 | | 8/2001 | Krumme et al. | |
| 6,319,149 | B1 | | 11/2001 | Lee | |
| 6,319,150 | B1 | | 11/2001 | Werner et al. | |
| 6,435,981 | B2 | * | 8/2002 | Naruo et al. | 473/329 |

OTHER PUBLICATIONS

E–mail listing of U.S. Patents.

* cited by examiner

*Primary Examiner*—Sebastiano Passaniti
*Assistant Examiner*—Tom Duong
(74) *Attorney, Agent, or Firm*—Rothwell, Figg, Ernst & Manbeck

(57) ABSTRACT

A golf club head for hitting a golf ball farther than existing golf club heads and having a sole, a crown, and a face that includes a lower portion and an upper portion. The sole and crown are cast thinner than most other club heads to promote deformation when striking a golf ball. A parabolic shaped rise in both the crown and sole provide increased lateral strength while aiding in reducing the deformation of the ball at impact. The lower portion of the face has two end portions, and a center portion with the end portions having a first thickness. The center portion and the upper portion of the face have a second thickness that is thicker than the first thickness. In addition, the face includes a channel disposed around its peripheral and having a thickness that is thinner than either the first or second thickness. The overall effect of this invention is to reduce deformation of the golf ball at impact, which reduces the energy lost as heat in the golf ball, resulting in farther drives.

20 Claims, 3 Drawing Sheets

GOLF CLUB HEAD

BACKGROUND OF THE INVENTION

1. Field of the Invention

The present invention relates, generally, to a golf club head and, more specifically, to a golf club head with enhanced deformation for hitting a golf ball farther.

2. Discussion of the Background

When a golf club strikes a golf ball at rest, the ball is propelled at high speed from the tee to the landing area. Thus, the kinetic energy of the moving club head is converted to kinetic energy in the moving golf ball. The golf ball is only in contact with the face of the golf club for a few millionths of a second during impact and the distance achieved by the golf ball is a result of the combination of the initial velocity of the ball after impact, the launch angle, and the spin of the ball. Generally, however, the greater the velocity of the ball after impact, the farther the ball will travel.

The mass of the club head and the velocity at impact combine to determine the initial velocity of the golf ball after impact. However, not all of the energy transferred to the ball is converted to kinetic energy and manifested as velocity. Some of the energy manifests as heat in the ball. Much of the kinetic energy lost as heat is related to the viscoelastic response of the ball during deformation.

The present invention is, in part, a result of the discovery that a golf club face that deforms in preference to the ball will, unless it is a lossy viscoelastomer, generally have a smaller hysteresis loop on deformation and, therefore, result in less energy loss. In addition, it has been found that it is preferable that the face of the club head deform more than the remainder of the club head body. Thus, controlling deformation of the golf club head in preference to deformation of the golf ball will result in the golf ball traveling farther.

Generally, a golf club comprises a shaft portion, a head portion, and a grip portion. The part of the golf club head portion that comprises the hitting surface is referred to as the golf club "face". Generally, a golf club face abuts or is adjacent to both a top wall (or crown) of the club head and a bottom wall (or sole) of the club head.

Most "woods", such as the driver and the fairway woods, are in the form of a hollow shell (or perhaps filled with foam), usually of metal. Because only the best and strongest golfers can effectively swing a driver head that weighs more than 220 grams, the maximum weight of the club head is essentially a design constraint of the club head. Further, when the front side of the face of the golf club head strikes a golf ball, extremely large impact forces are produced potentially causing cracking and/or material failure. Thus, the golf club face portion must be structurally adequate to withstand large repeated forces, such as those associated with ball impact. In addition, a large club head face is highly desirable because it strongly reduces the percentage of errant hits.

Thus, there are contrasting design considerations when designing a golf club head—the desirability of a light club head, but with a large club face and a club head that is durable enough to withstand repeated striking of the ball. One method of increasing the durability of the club head is to add additional material (e.g., steel or titanium) to thicken the club face or to add ribs to the club face. However, the designer cannot simply add additional material to strengthen the face indiscriminately because doing so also increases the overall weight of the club head, which is undesirable.

Prior golf club heads typically had relatively thick faces, which would deform only slightly at impact thereby causing the golf ball to deform, which created a significant loss of kinetic energy through conversion of heat in the ball. Also, at impact, most faces vibrate at a fundamental frequency of 4,000 to 5,000 Hertz. The present invention results in significantly greater deformation of the club face at impact and a higher fundamental frequency of about 6,000 Hertz at impact. The result is a significantly lower deformation of the ball resulting in less loss of energy through heat conversion in the ball and consequently a higher initial velocity at impact, resulting in greater distance of ball flight.

Thus, there is a need for a new golf club head with a club face structure providing enhanced deformation for improving club performance, and that has structural integrity, thereby reducing cracking and material failure, without otherwise adversely affecting club performance, look, and feel; and with limited affect on club head weight.

SUMMARY OF THE INVENTION

The primary object of the present invention is to overcome the deficiencies of the prior art described above by providing a golf club head with enhanced deformation for hitting a golf ball farther.

Another key object of the present invention is to provide a golf club head that imparts more kinetic energy to the golf ball than existing club heads.

Another key object of the present invention is to provide a golf club head that reduces the amount of energy that is converted to heat in the ball when striking the ball.

Still another key object of the present invention is to provide a golf club head having a club face that has portions that are thin enough to permit enhanced deformation and that are durable enough to avoid structural failure from repeated use.

Yet another object of the present invention is to provide a club head with enhanced deformation that results in the golf ball traveling farther, that is achieved without exceeding a preferred club head weight.

Still another object of the present invention is to provide a golf club head having a higher fundamental frequency than comparable existing club heads.

The present invention accomplishes these objects and others by providing a golf club head having a sole, a crown, and a face. The face has a lower portion and an upper portion. The lower portion of the face has two end portions, and a center portion with the end portions having a thickness, which is thinner than the center portion thereby permitting deformation of the face. The range of thickness of the end portions is about 0.055 to 0.065 inches and preferably from 0.0575 to 0.0625 inches and most preferably approximately 0.060 inches. The center portion and the upper portion of the face have a thickness in a range of about 0.070 to 0.080 inches and preferably from 0.0725 to 0.0775 inches, and most preferably approximately 0.075 inches. In addition, the face includes a channel disposed around its periphery and has a thickness in the range of 0.0525 inches to 0.0575 inches and preferably of approximately 0.055 inches.

In addition, the club head includes a number of structures having a parabolic shape including a parabolic rise in the crown, the sole, and the parabolic junctures of the center portion and end portions of the lower portion of the face. The parabolic shaped structures increase the structural strength of the club head thereby greatly enhancing the ability of the club face to deform more than the ball at impact while maintaining structural integrity.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated herein and form part of the specification, illustrate various embodiments of the present invention and, together with the description, further serve to explain the principles of the invention and to enable a person skilled in the pertinent art to make and use the invention. In the drawings, like reference numbers indicate identical or functionally similar elements.

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

In the following description, for purposes of explanation and not limitation, specific details are set forth, such as particular materials, shapes, methods of manufacture, casting processes, etc. in order to provide a thorough understanding of the present invention. However, it will be apparent to one skilled in the art that the present invention may be practiced in other embodiments that depart from these specific details. Detailed descriptions of well-known casting processes, materials, golf club shapes, methods of manufacturing, devices, components, shafts, uses, techniques, and associated technologies, are omitted so as not to obscure the description of the present invention.

Figure 1:
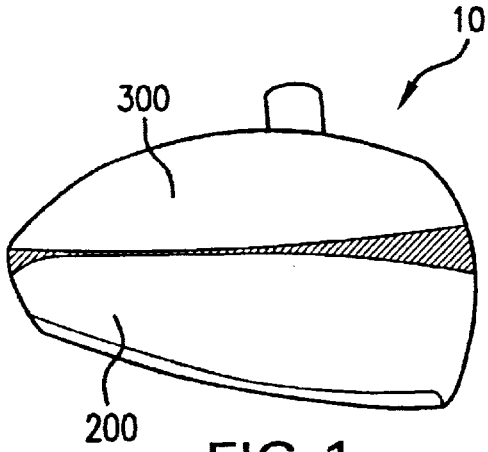
FIG. 1 is a front side view of an example embodiment of a club head of the present invention.
Figure 2:
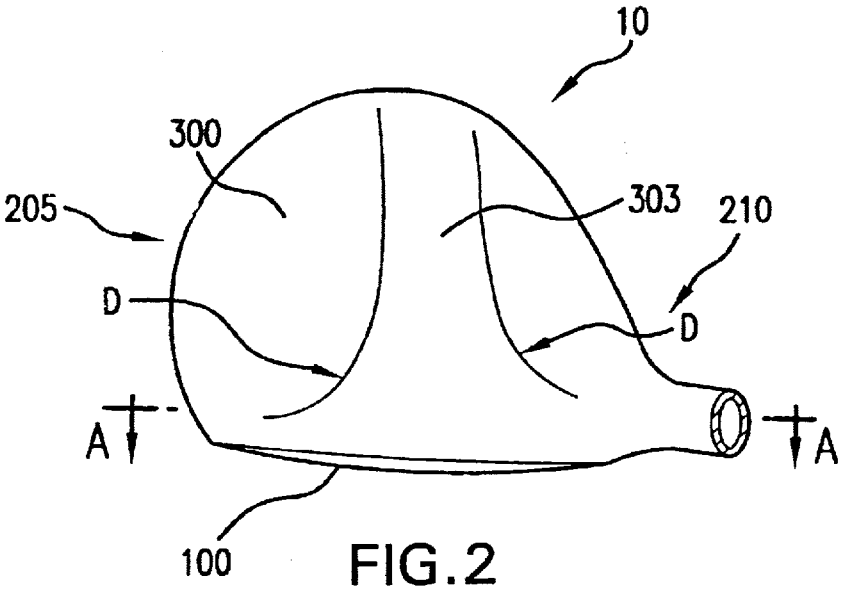
FIG. 2 is a top view of an example embodiment of a club head of the present invention.
Figure 3:
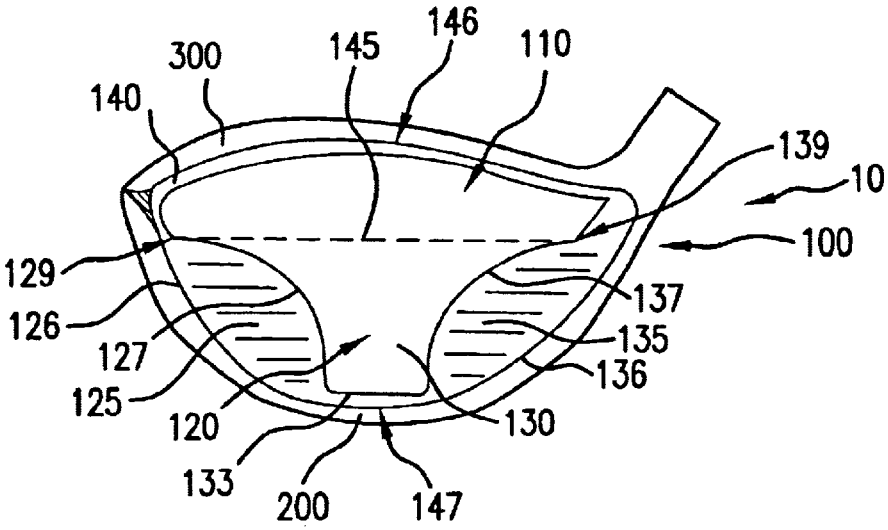
FIG. 3 is a right side view of a club head of an example embodiment of the present invention.

As shown in FIGS. 1–5, the present invention includes a sole 200, a crown 300, and a face portion 100, which together form a cavity. Referring specifically to FIG. 3, in the example embodiment of the present invention, the face portion 100 includes an upper portion 110, which is above the dashed line 145 shown in FIG. 3, and a lower portion 120, which is below the dashed line 145 shown in FIG. 3. The horizontal and vertical lines of FIG. 3 identify portions of the face portion 100 that have substantially the same thicknesses.

The lower portion 120 includes a lower toe portion 125 that is located towards the toe of the club head, a lower heel portion 135 that is positioned towards the heel of the club head, and a center portion 130 between the lower toe portion 125 and lower heel portion 135. The lower toe portion 125, which is generally oval in shape or more particularly shaped in two inverted ellipses, or approximately like a football, includes an outer edge 126 that is towards the sole 200 and the toe 205 of the club head and an inner edge 127 that is adjacent the center portion 130. Likewise, the lower heel portion 135, which is generally oval in shape, or more particularly shaped like a football, includes an outer edge 136 that is towards the sole 200 and heel 210 of the club head and an inner edge 137 that is adjacent the center portion 130.

The outer edge 126 of the lower toe portion 125 is slightly curved and is adapted to mate with the front edge of sole 200. The inner edge 127 of the lower toe portion 125 is curved and in particular is generally parabolic in shape in this example embodiment. In addition, the inner edge 127 extends from the upper portion 110 near the toe 205 to about one third of the distance to the heel 210 from the toe 205. The radius of curvature of the inner edge 127 of the lower toe portion 125 is 0.75 inches as the inner edge 127 approaches the center portion 130.

The outer edge 136 of the lower heel portion 135 is slightly curved and is adapted to mate with the front edge of sole 200. The inner edge 137 of the lower heel portion 135 is curved and in particular is generally parabolic in shape in this example embodiment. In addition, the inner edge 137 extends from the upper portion 110 near the heel 210 to about one third of the distance to the toe 205 from the heel 210. The radius of curvature of the inner edge 137 of the lower heel portion 135 is 0.75 inches as the inner edge 137 approaches the center portion 130.

The center portion 130 of lower portion 120 includes a heel side edge which coincides with inner edge 137, a bottom edge 133, a toe side edge which coincides with inner edge 127, and a top edge indicated by dashed line 145. The bottom edge 133 of the center portion is substantially straight and is 0.079 inches in length. The top edge of the center portion 130 is integral with the upper portion 110 and the vertical distance from the bottom edge 133 of the center portion 130 to the top center edge 146 of the upper portion 110 is 1.75 inches. As discussed above, the parabolic shape of the edges provide increased strength, which greatly enhances the ability of the club face to deform more than the ball while maintaining structural integrity.

As is evident in the figures, the upper portion 110 extends substantially the entire length of the face 100 (i.e., substantially the entire distance from the heel to the toe). In addition, the upper portion 110 in this example embodiment extends from near the top center 146 edge of the face 100 about one fourth to one half of the distance from the top center edge 146 to the bottom center edge 147 as indicated by the dashed line 145 in FIG. 3. In this embodiment, the dashed line 145 indicates the separation of the upper 110 and lower portions 120 also coincides with the upper ends 129 and 139 of inner edges 127 and 137, respectively. In alternate embodiments of the present invention, the upper portion 110 could extend a longer or shorter distance down the face 100. In this embodiment, the upper portion 110 extends nearly, but not quite all the way, to the very top edge 146. The radius of curvature of the upper end 129 of the upper portion 110 near the toe is 0.05 inches.

Substantially all of the upper portion 110 and the lower center portion 130 have substantially the same thicknesses.

In this example embodiment, the thickness of lower center portion 130 and upper portion 110 is in the range of 0.070 inches to 0.080 inches and is preferably from 0.0725 inches to 0.0775 inches, and most preferably approximately 0.075 inches. The lower toe portion 125 and the lower heel portion 135 are also substantially the same thickness, which is in the range of 0.055 to 0.065 inches and preferably 0.0575 to 0.0625 inches and most preferably approximately 0.060 inches.

Figure 5:
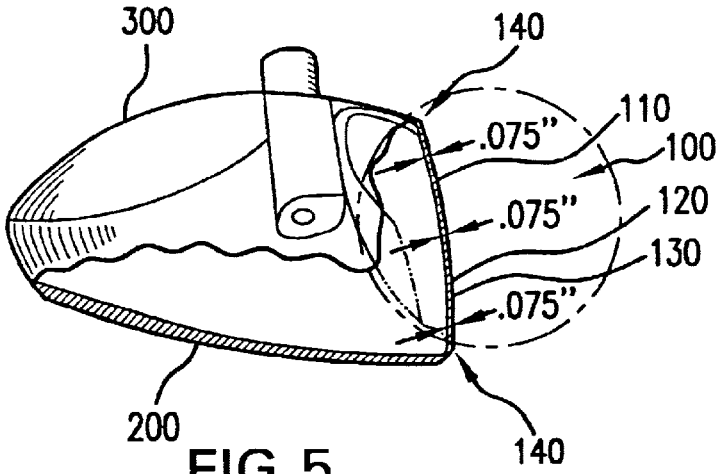
FIG. 5 is a cross-sectional view of an example embodiment of a club head of the present invention along line B—B of FIG. 4.
Figure 6:
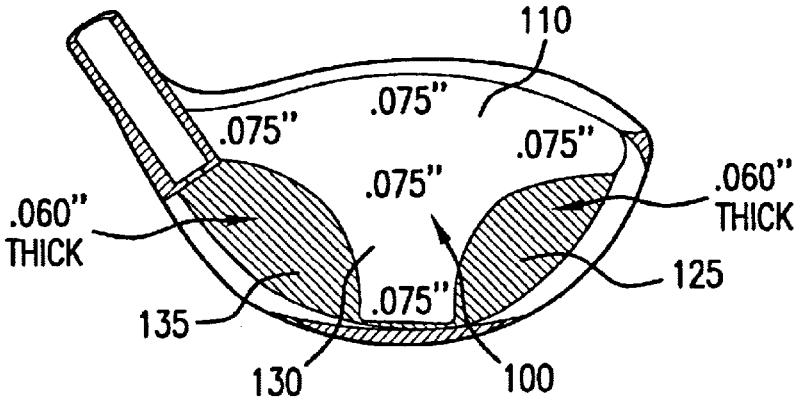
FIG. 6 is a cross-sectional view of an example embodiment of a club head of the present invention along line A—A of FIG. 2.

As shown in FIGS. 3 and 5, in this embodiment a channel 140 is disposed around the peripheral of the face 100. The channel 140 has a curved surface on the inside of the club head 10 (i.e., the back side of the face 100). In addition, the channel 140 is thinner than the other portions of the face 100, thereby aiding in the deformation of the club face 100. In this example embodiment, the channel 140 is approximately 0.005 inches thinner than the thickness of the adjacent face portion 100. The channel 140 is 0.003 inches wide and is preferably in the range of 0.0525 inches to 0.0575 inches and more preferably approximately 0.055 inches thick at its thinnest point. Channels in other embodiments of the present invention may extend only partially around the face, or not at all, and may be other thicknesses.

The present invention also includes the removal of conventional score lines in the center of the face where the face is thickest, in a shape that profiles the parabolic shape. More specifically, the face portion 100 includes a portion that has no score lines that is shaped substantially as an inverted triangle (i.e., base at the top) with a truncated apex (i.e., connected points 129, 139 with the respective corners of the lower center portion 130 as shown in FIG. 3). The score lines on the outside of the face portion 100 end outside the internal parabolic shaped inner edges 137, 127 of the lower heel portion 135 and lower toe portion 125. The effect is to further strengthen the hitting area of the face and to further improve durability. Alternate embodiments of the present invention could include score lines over part or all of the face.

Figure 4:
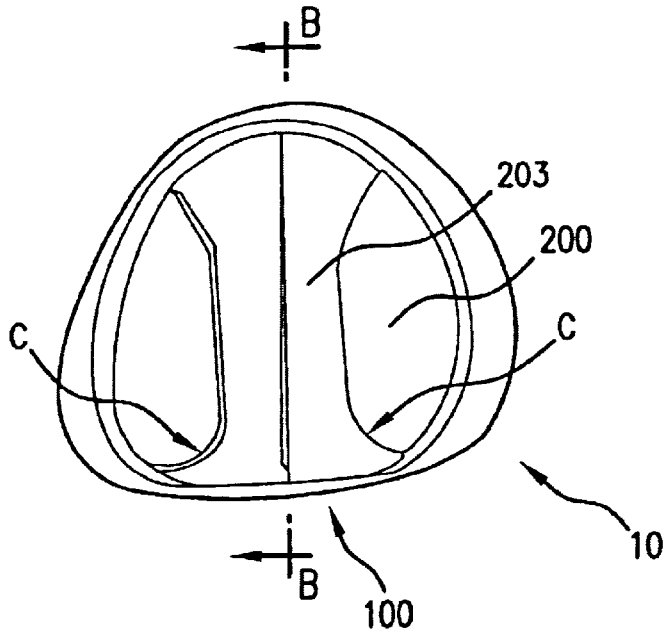
FIG. 4 is a bottom view of an example embodiment of a club head of the present invention.

As shown in FIG. 4, the sole 200 of the club head 10 includes a ridge across the sole 200 that produces a center rail 203 from back to front with a parabolic rise towards the face 100 of the club. The parabolic rise (indicated by the arrows labeled C in FIG. 4) on the sole 200 provides additional lateral strength to the club head, without adding thickness to the sole 200 while still permitting the sole 200 to bend at impact with a golf ball on the face. The center rail 203 also aids the golfer when setting up to strike the ball and assists the golfer in getting the ball airborne. Thus, the center rail 203 reduces friction should the club hit the ground while swinging so that the club may be used as a fairway wood. The wall thickness of the sole 200 is 0.035 inches and the radius of curvature of the parabolic rise is 0.5 inches. The center rail is approximately 1.09 inches wide at its narrowest point.

As shown in FIG. 2, the crown 300 includes a center ridge 303 across the crown 300 from back to front with a parabolic rise towards the face 100 of the club. The parabolic rise (indicated by the arrows labeled D in FIG. 2) on the crown 300 provides additional lateral strength to the club head, without adding thickness to the crown 300 while still permitting the crown 300 to bend at impact. The center ridge 303 also provides a visual aid to the golfer when setting up to strike the ball. The wall thickness of the crown 300 is 0.035 inches and the radius of curvature of the parabolic rise is 1.150 inches. The center ridge 303 is approximately 0.7 inches wide at the rear of the club and is 3.4 inches wide towards the front of the club head.

As discussed above, the parabolic rise in the sole 200 and crown 300 provides increased strength, which greatly enhances the ability of the club face to deform more than the ball and to maintain structural integrity.

It is also preferable that the wall thickness of the sole 200 and crown 300 vary, being slightly thicker toward the heel. The varying thickness moves the center of gravity toward the heel, which improves performance by building in a hook bias thereby assisting the golfer in pronating the club head as the club approaches the ball during the swing. In this example embodiment, the crown and sole vary from about 0.035 inches at the toe to about 0.040 inches at the heel.

In the preferred method of making the example embodiment, the crown is cast with the face and a small lip that extends rearward approximately 0.25 inches from the face. The sole is then welded to the crown and to the lip extending from the face as shown by the jagged line of FIG. 5. By this manufacturing procedure, the thickness of the connection of the face to the crown can be accurately controlled. In this embodiment, the club head is formed of steel, but other embodiments may use alternative materials such as titanium, Teflon, or like materials, and different portions of the club head may be made of different materials. The face of the steel club head is polished (shiny) so that the impact of the ball with the club head results in a mark where the ball impacted the club head face. Thus, the club head face provides feedback to the golfer regarding where on the club face the golfer is striking the ball. The polished nature of the club face allows the golfer to repeatedly get the feedback by periodically wiping the club face clean.

In the present example embodiment, the shaft is attached to the club head 10 in any conventional fashion. The shaft may be any shaft suitable for the golfer such as Penley® or Graphite Design® shafts. The hosel neck protrudes 0.500 inch out of the heel end of the crown. The total hosel depth is 1.500 inch from the top of the hosel to the seat within the club head, so the hosel is one inch into the club head. The total distance from the tip of the hosel to the sole is 3.150 inch.

The club of the above example is USGA compliant with a club head that is 280 cubic centimeters and weighs 200 g±4 g. The weight of the sole plate is 46 g±4 g. Tables 1 and 2 below provide a number of parameters for golf clubs having 9.5 and 11 degree lofts, respectively.

TABLE 1

| | RH 9.5° | RH 11° |
|---|---|---|
| LOFT ANGLE | 9.5° | 11.0° |
| LIE ANGLE | 55.0 | 55.0 |
| FACE ANGLE | 1.0 close | 1.0 close |
| BULGE RADIUS | 10" R inch | 10" R inch |
| ROLL RADIUS | 9" R inch | 7" R inch |
| BOUNCE METRIC | 1° | 1° |
| FRONT TO BACK | 20" R inch | 20" R inch |
| HEEL TO TOE | 6" R inch | 6" R inch |

TABLE 2

| | RH 9.5° | RH 11° |
|---|---|---|
| INSIDE DIAMETER | 0.348 | 0.348 |
| OUTSIDE DIAMETER | 0.490 | 0.490 |
| HOSEL DEPTH | 1.500 | 1.500 |

TABLE 2-continued

| | RH 9.5° | RH 11° |
|---|---|---|
| CHAMFER SIZE | .032 R .080 | 032 R .080 Depth |
| HOSEL PAINT TAPE LINE | 0.500 | 0.500 |
| BOTTOM HOSEL TRUE HOLE DIAM. | 0.250 | 0.250 |
| WALL THICKNESS | 0.050 | 0.050 |

The outside diameter of the hosel is .500 inch and the inside diameter is .348 inch.

Figure 7:
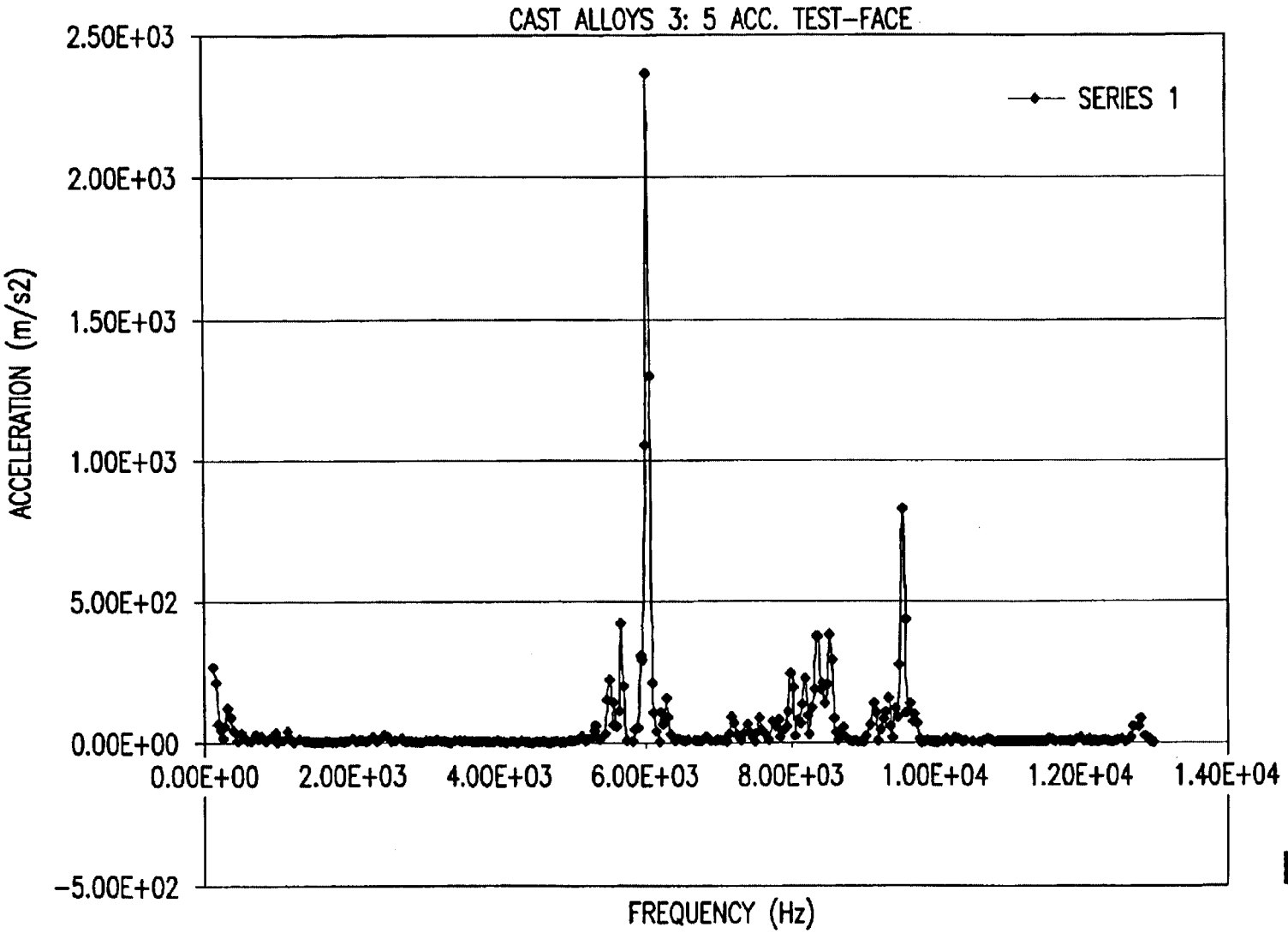
FIG. 7 depicts the vibrational response of an example embodiment of a golf club according to the present invention striking a golf ball.

FIG. 7 depicts the vibrational response of a golf club embodying the present invention striking a golf ball, which relates to the club's fundamental frequency. The resultant golf club provides a higher fundamental frequency than existing club heads. The combination of high fundamental frequency and greater deformation of the club head reduces the energy lost as heat in the golf ball (and club) at impact.

The club head of the present invention is suitable for use as a driver or wood. The size, weight, and angle on the face of the club head of the present invention may vary depending on the use of the club head in, for example, a driver, 3-wood, 5-wood, etc. For example, the club head of the present invention used in a 3-wood is about ⅔ the size of the club head used in a driver, and the angle on the face is about 13 degrees. The angle on the face of the club head of the present invention used in, for example, a 5-wood is about 17 degrees. The volume of the club head of the present invention used in a driver may be, for example, about 280 cc, or may be about 380 cc in an oversized or jumbo type driver.

While the above example embodiment includes a center portion 130 that has two curved sides that abut lower heel portion 135 and lower toe portion 125, in an alternative embodiment the sides could be straight so that inner edges 137 and 127 are straight. In addition, while the transition from the thickness of the center portion to the thicknesses of the lower toe portion 125 and lower heel portion 135 (which define edges 127 and 137, respectively) is abrupt in the above example embodiments, in an alternate embodiment the transition could be more gradual (for example, transitioning over a half inch, three eighths of an inch, quarter inch, eighth inch, or sixteenth of an inch).

While the above example embodiment includes a center portion 130 that has a substantially flat lower edge, alternate embodiments could include a rounded bottom edge or a pointed lower end. In addition, while the thickness of the lower toe portion 125 and lower heel portion 135 are the same in the above example embodiment, in an alternate embodiment they could be different with the lower heel portion 135 being thicker than the lower toe portion 125 or vice versa.

The foregoing has described the principles, embodiments, and modes of operation of the present invention. However, the invention should not be construed as being limited to the particular embodiments described above, as they should be regarded as being illustrative and not as restrictive. It should be appreciated that variations may be made in those embodiments by those skilled in the art without departing from the scope of the present invention.

While a preferred embodiment of the present invention has been described above, it should be understood that it has been presented by way of example only, and not limitation. Thus, the breadth and scope of the present invention should not be limited by the above described exemplary embodiment.

Obviously, numerous modifications and variations of the present invention are possible in light of the above teachings. It is therefore to be understood that within the scope of the appended claims, the invention may be practiced otherwise than as specifically described herein.

What is claimed is:

1. A wood-type golf club head, comprising:

a crown a sole coupled to said crown; and a face coupled to said sole and said crown and having an upper portion, a lower portion, a toe side edge, a heel side edge, and a bottom edge;

said lower portion of said face having a lower toe portion located towards a toe of the golf club head, a lower heel portion located towards a heel of the golf club head, and a center portion located between the lower toe portion and the lower heel portion and shaped substantially in the form of a trapezoid;

said lower toe portion and said lower heel portion each being substantially oval in shape and each having a side that is generally parabolic in shape, wherein the parabolic side of the lower toe portion extends from a point substantially on the toe side edge of the face to a first point substantially on the bottom edge of the face and the parabolic side of the lower heel portion extends from a point substantially on the heel side edge of the face to a second point substantially on the bottom edge;

said center portion having a heel side that coincides with the side of the lower heel portion that is generally parabolic in shape, a toe side that coincides with the side of the lower toe portion that is generally parabolic in shape, and an upper side that coincides with at least a portion of a lower side of the upper portion;

said lower toe and lower heel portions having a first substantially uniform thickness; and said center portion and the upper portion of the face have a second substantially uniform thickness wherein said second thickness is thicker than said first thickness.

2. The wood-type golf club head of claim 1, wherein the second thickness is greater than the first thickness by no more than about 0.025 inches and the second thickness is less than about 0.030 inches.

3. The wood-type golf club head of claim 1, wherein said upper portion comprises at least about the entire upper one third of said face portion but not more than about the entire upper half of the face portion.

4. The wood-type golf club head of claim 1, wherein the width of said upper portion is between about ¼ and ½ of the width of the entire face and the length of the upper portion is about equal to the length of the face.

5. A wood-type golf club head, comprising:

a sole portion;

a crown portion coupled to said sole portion;

a face portion coupled to said crown portion and said sole portion and having an upper portion and lower portion;

said face portion having a top center edge, a bottom center edge, a first side edge, and a second side edge;

said lower portion having a lower toe portion located towards the toe of the golf club head, a lower heel portion located towards the heel of the golf club head, and a center portion located between the lower toe portion and the lower heel portion;

said upper portion extending from said top edge a distance in a range of about one fourth to one half of the distance from said top center edge to said bottom center edge;

said upper portion extending substantially the entire length of said face portion;

said lower toe portion and said lower heel portion having a substantially uniform thickness in a range of about 0.0575 inches to 0.0625 inches;

said center portion and said upper portion having a substantially uniform thickness in a range of about 0.0725 inches to 0.0775 inches.

6. A wood-type golf club head, comprising:

a sole portion;

a crown portion coupled to said sole portion;

a face portion coupled to said crown portion and said sole portion and consisting of an upper portion and lower portion;

said lower portion consisting of a lower toe portion located towards the toe of the golf club head, a lower heel portion located towards the heel of the golf club head, and a center portion located between the lower toe portion and the lower heel portion;

said lower toe portion and said lower heel portion having a substantially parabolic curved side and having a thickness in a range of about 0.055 inches to 0.065 inches; and said center portion and said upper portion having a thickness in a range of about 0.070 inches to 0.080 inches.

7. The wood-type golf club head of claim 6, wherein said upper portion and said center portion of said lower portion have a thickness in a range of about 0.0725 inches to 0.0775 inches.

8. The wood-type golf club head of claim 6, wherein said first end lower toe portion and said lower heel portion have a thickness in a range of about 0.0575 inches to 0.0625 inches.

9. The wood-type golf club head of claim 6, wherein said upper portion includes substantially the entire upper half of said face portion.

10. The wood-type golf club head of claim 6, wherein said upper portion includes substantially the entire upper one third of said face portion.

11. The wood-type golf club head of claim 6, wherein said upper portion includes substantially the entire upper one fourth of said face portion.

12. The wood-type golf club head of claim 6, wherein said center portion includes a first side abutting said lower toe portion and a second side abutting said lower heel portion.

13. The wood-type golf club head of claim 12, wherein said first side and said second side are curved.

14. The wood-type golf club head of claim 12, wherein said first side and said second side of center portion are substantially parabolic in shape.

15. The wood-type golf club head of claim 6 wherein said lower toe portion and said lower heel portion are substantially elliptical in shape.

16. The wood-type golf club head of claim 6, wherein the golf club further comprises a front side and a back side and said crown portion includes a ridge from said back side to said front side, and said ridge having a first and second side; said first and second sides of said ridge being substantially parabolic in shape.

17. The wood-type golf club head of claim 6, wherein the golf club further comprises a front side and a back side and said sole portion includes a rail from said back side to said front side, and said rail having a first and second side; said first and second sides of said rail being substantially parabolic in shape.

18. The wood-type golf club head of claim 17, wherein said crown portion includes a ridge from said back side to said front side, and said ridge having a first and second side; said first and second sides of said ridge being substantially parabolic in shape.

19. The wood-type golf club head of claim 6, wherein the golf club further comprises a toe end and a heel end and said sole portion and said crown portion have a thickness greater at said heel end than at said toe end.

20. The wood-type golf club head of claim 6, wherein said crown portion is integral with said face portion, and said face portion includes an integral lip portion extending therefrom, said crown portion and said face portion thereby forming an upper assembly and said sole portion is welded to said upper assembly.

* * * * *